US010123638B2

(12) United States Patent
Thorn

(10) Patent No.: US 10,123,638 B2
(45) Date of Patent: Nov. 13, 2018

(54) PILLOW

(71) Applicants: OAKTHRIFT CORPORATION LTD, Hertfordshire (GB); James John Thorn, Rochford (GB)

(72) Inventor: James John Thorn, Rochford (GB)

(73) Assignee: OAKTHRIFT CORPORATION LTD., Borehamwood (GB)

( * ) Notice: Subject to any disclaimer, the term of this patent is extended or adjusted under 35 U.S.C. 154(b) by 0 days.

(21) Appl. No.: 15/121,932

(22) PCT Filed: Feb. 24, 2015

(86) PCT No.: PCT/GB2015/050514
§ 371 (c)(1),
(2) Date: Aug. 26, 2016

(87) PCT Pub. No.: WO2015/128623
PCT Pub. Date: Sep. 3, 2015

(65) Prior Publication Data

US 2017/0065108 A1 Mar. 9, 2017

(30) Foreign Application Priority Data

Feb. 28, 2014 (GB) ..... 1403530.7

(51) Int. Cl.
*A47G 9/02* (2006.01)
*A47G 9/10* (2006.01)
(Continued)

(52) U.S. Cl.
CPC ..... *A47G 9/1027* (2013.01); *A42B 1/00* (2013.01); *A47C 7/383* (2013.01); *A47G 2009/003* (2013.01); *A47G 2009/1018* (2013.01)

(58) Field of Classification Search
CPC .. A47G 9/1027; A47G 9/1072; A47G 9/1081; A47G 2009/003; A47G 2009/1018; A47G 9/10; A47C 7/383; A42B 1/00
See application file for complete search history.

(56) References Cited

U.S. PATENT DOCUMENTS 3,017,221 A * 1/1962 Emery ..... A47C 7/383 297/397
3,608,964 A * 9/1971 Earl ..... A47C 7/383 297/397
(Continued)

FOREIGN PATENT DOCUMENTS

DE 200620005501 8/2006
JP 3132278 U 6/2007

*Primary Examiner* — Nicholas F Polito
*Assistant Examiner* — Rahib T Zaman
(74) *Attorney, Agent, or Firm* — Weiss & Moy, P.C.; Jeffrey D. Moy

(57) ABSTRACT

A pillow comprises a substantially U-shaped body defining a recess adapted to house the neck of a user. The U-shaped body has a rear portion and first and second side portions that define a rear wall and first and second side walls of the recess and define a shoulder-contacting base and an upper surface. The pillow has a first inflatable headrest having a lower part housed in the recess adjacent the first side wall of the recess and a second inflatable headrest having a lower part housed in the recess adjacent the second side wall of the recess. The first and second inflatable headrests are each alterable between a first configuration wherein they are deflated and a second configuration wherein they are inflated such that respective upper parts of the headrests extend upwardly from the recess so as to cover respective ears of a user.

18 Claims, 4 Drawing Sheets

(51) Int. Cl.

| | |
|---|---|
| ***A42B 1/00*** | (2006.01) |
| ***A47C 7/38*** | (2006.01) |
| *A47G 9/00* | (2006.01) |

(56) References Cited

U.S. PATENT DOCUMENTS 4,345,347 A * 8/1982 Kantor ..... A47C 7/383 5/490
5,454,781 A * 10/1995 Chitwood ..... A61F 5/04 128/845
5,505,523 A * 4/1996 Wang ..... A47C 7/383 128/870
5,567,015 A * 10/1996 Arias ..... A47C 7/383 297/397
5,630,651 A * 5/1997 Fishbane ..... A47C 7/383 297/391
5,974,607 A * 11/1999 Smith ..... A61G 7/072 297/393
6,170,486 B1 * 1/2001 Islava ..... A61F 5/055 128/869
6,289,538 B1 * 9/2001 Fidge ..... A47C 7/383 297/393
6,651,256 B1 * 11/2003 Swift ..... A42B 1/004 2/15
7,657,954 B1 * 2/2010 Bunkers ..... A42B 1/048 2/202
7,797,773 B1 * 9/2010 Wilk ..... A47C 7/383 5/640
8,144,913 B1 * 3/2012 Myles, Jr. ..... H04R 5/023 381/333
8,251,939 B2 * 8/2012 Aune ..... A61H 1/0296 602/18
8,783,776 B1 * 7/2014 Perkins ..... A47D 15/00 297/219.12
2006/0267392 A1 * 11/2006 Charnitski ..... B60N 2/4882 297/393
2009/0133192 A1 * 5/2009 Hassell ..... A47G 9/064 5/639
2009/0235459 A1 * 9/2009 Tidwell ..... A47C 16/00 5/640

* cited by examiner

PILLOW

The present invention relates to a pillow. In particular the present invention relates to a travel pillow.

Travel pillows are commonly used on long haul airplane flights where a traveller must attempt to sleep in a seated position.

Typically travel pillows are often formed of memory foam, are U-shaped in configuration, and are adapted to be retained around the neck of a user such that the user may rest their head on either side of the pillow.

In order to aid retention of a pillow around the neck of a user some existing travel pillows comprise an attachment adapted to attach together the free ends of the U-shaped pillow.

However, existing pillows have various drawbacks, in particular it is not always easy to rest one's head against in a fully relaxed position, particularly if one is adjacent an airplane window.

Furthermore, existing pillows do not mitigate against unwanted noise that might keep a user awake.

The present invention seeks to address these issues.

According to the present invention there is provided a pillow comprising:

a substantially U-shaped body defining a recess adapted to house the neck of a user, the U-shaped body having a rear portion and first and second side portions that define a rear wall and first and second side walls of the recess and define a shoulder-contacting base and an upper surface;

a first inflatable headrest having a lower part housed in the recess adjacent the first side wall of the recess;

a second inflatable headrest having a lower part housed in the recess adjacent the second side wall of the recess; wherein first and second inflatable headrests are each alterable between a first configuration wherein they are deflated and a second configuration wherein they are inflated such that respective upper parts of the headrests extend upwardly from the recess so as to cover respective ears of a user.

Providing a pillow having a U-shaped body and two inflatable headrests each having a lower part housed in the recess adjacent respective side walls means that when the pillow is in use the inflated headrests must deform to accommodate the user's head. In particular the lower parts of the headrests are deformed by the jaw of a user. This in turn pressurizes the upper part of each headrest such that each headrest is held firmly against each side of a user's head, thereby maintaining the user's head in a substantially upright position and maintaining ear coverage.

In some embodiments at least 15% of the length of a headrest is located within the recess adjacent a side wall thereof.

In some embodiments at least 25% of the length of a headrest is located within the recess adjacent a side wall thereof.

In some embodiments at least 35% of the length of a headrest is located within the recess adjacent a side wall thereof.

The greater the proportion of headrest that is housed within the recess the more pressurized the upper part of the headrest may be made when the pillow is in use.

In some embodiments the lower part of a headrest extends from adjacent the base of the U-shaped body to the upper surface of the U-shaped body.

In some embodiments a headrest is formed separately from the U-shaped body and is releasably attachable to a side wall of the recess.

In some embodiments the U-shaped body comprises a covering at least partly made of a material that acts as one half of hook and loop fastening.

In some embodiments a headrest may be attachable to the U-shaped body by means of hook and loop fastening.

In some embodiments a headrest is substantially wedge-shaped with a lower end adjacent a side wall of the recess of the pillow tapering outwardly towards a wider upper end.

In some embodiments the first and second headrests are independently inflatable.

In some embodiments the headrests are in fluid communication with each other.

By providing headrests in fluid communication with each other they may be inflated and deflated simultaneously.

Preferably the pillow comprises a connector adapted to attach together free ends of the U-shaped body.

By providing a connector to attach together free ends of the U-shaped body a user may tension the connection so to more effectively pressurize the headrests.

Preferably the U-shaped body is substantially filled with foam.

Even more preferably the U-shaped body is substantially filled with memory foam.

Preferably the U-shaped body is substantially semi-circular in cross-section with the arc of the semi-circle forming the outer wall of the U-shaped pillow and the diameter of the semi-circle forming the rear wall and first and second side walls of the recess.

By providing substantially flat side walls to the recess the lower parts of the headrests are more effectively clamped.

In some embodiments a headrest when inflated extends out of the recess by at least 10 cm.

In some embodiments a headrest when inflated extends out of the recess by at least 15 cm.

In some embodiments a headrest when inflated extends out of the recess by at least 20 cm.

In some embodiments when the headrests are inflated and the item is not in use the upper parts of the headrests contact each other.

In some embodiments when the headrests are inflated and the item is not in use the lower parts of the headrests contact each other.

In order that the invention may be more fully understood a specific embodiment will now be described by way of example with reference to the accompanying drawings, of which:

Figure 1:
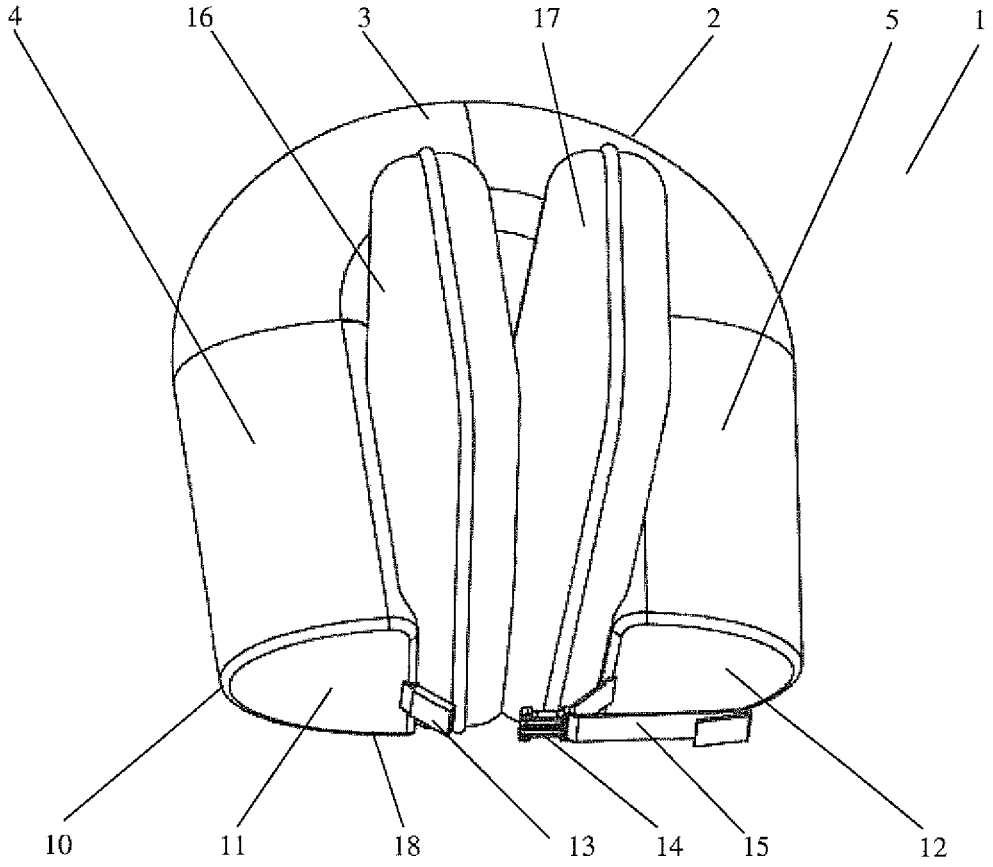
FIG. 1 is a front view of a pillow made in accordance with a first embodiment of the present invention and with its headrests extended.

Referring to the drawings, there is provided a pillow 1 comprising a substantially U-shaped body 2 having a curved rear portion 3, a first substantially straight side portion 4 and second substantially straight side portion 5 defining neck-housing recess 6.

Curved rear wall 7 of recess 6 is defined by rear portion 3. Substantially linear first side wall 8 of recess 6 is defined by first side portion 4 and substantially linear second side wall 9 of recess 6 is defined by second side portion 5.

U-shaped body 2 is substantially semi-circular in cross-section with the diameter of the semicircle forming walls 7, 8, 9 of recess 6 and the outer wall 10 of U-shaped body 2 being curved in profile.

First side portion 4 of U-shaped body 2 comprises first free end 11 and second side portion 5 of U-shaped body 2 comprises second free end 12.

Located on first free end 11 is first connector half 13 and located on second free end 12 is second connector 14.

First and second connector halves 13, 14 are attached to respective first and second free ends 11, 12 by webbing 15, which is adjustable in length at second connector half 14. First connector half 13 is a female half and second connector half 14 is a male half.

First and second connector halves 13, 14 are adapted to mate together and thereby connect together free ends 11, 12 of U-shaped member 2 so as to retain U-shaped member 2 in position around a user's neck when pillow 1 is in use.

Figure 2:
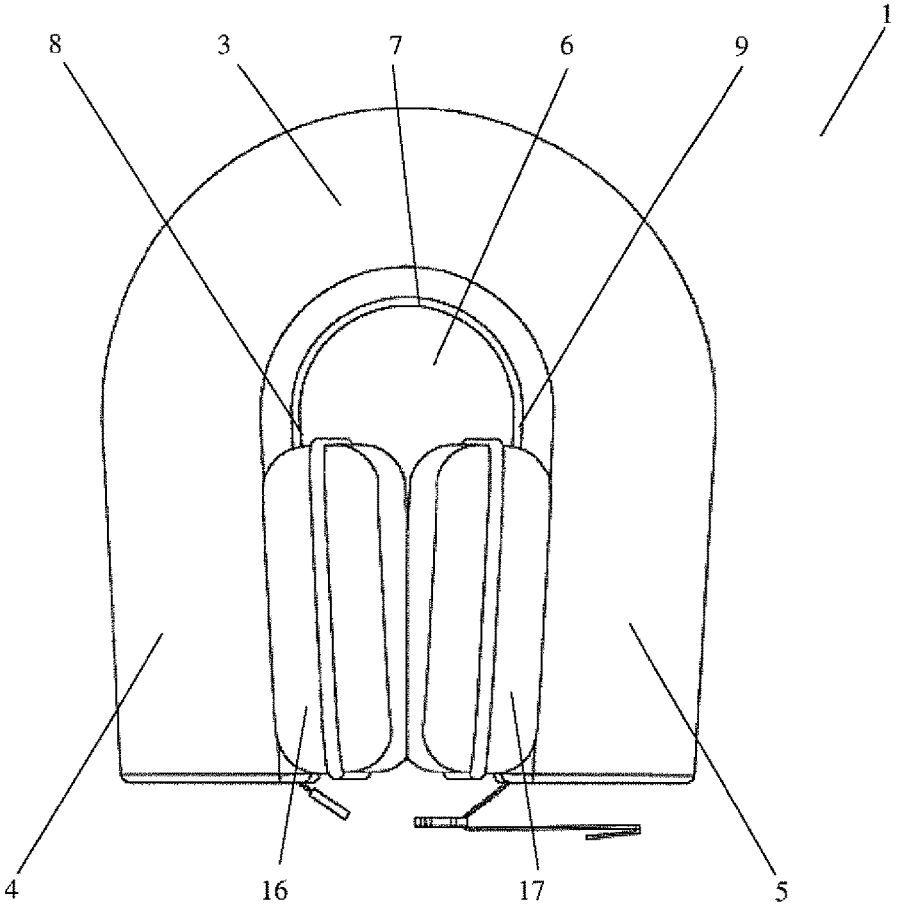
FIG. 2 is a plan view of the pillow of FIG. 1.

As best seen in FIG. 2, side portions 4, 5 of U-shaped body 2 are angled slightly toward each other such that recess 6 narrows between rear portion 3 of U-shaped body 2 and free ends 11, 12 of respective side portions 4, 5. This narrowing results in pillow 1 being retained upon a user's neck positioned within recess 6 even without connector 13, 14 being deployed.

Attached to first side wall 8 of recess 6 is first headrest 16, and attached to second side wall 9 of recess 6 is second headrest 17. Headrests 16, 17 are elongate and substantially cuboid in shape.

First headrest 16 extends between free end 11 of first side portion 4 and curved rear portion 3 of U-shaped body 2. Similarly second headrest 17 extends between free end 12 of second side portion 5 and curved rear portion 3 of U-shaped body 2.

Headrest 16 is attached to first side wall 8 of recess 6 such that a lower end of head rest 16 is substantially flush with the shoulder-contacting base 18 of U-shaped member 2. Headrest 16 extends through recess 6 and out above the upper surface 19 of U-shaped member 2. Thus a lower portion of headrest 16 is housed within recess 6 and an upper portion of headrest 16 extends upwardly from recess 6.

Similarly headrest 17 is attached to second side wall 9 of recess 6 such that a lower end of head rest 17 is substantially flush with the shoulder-contacting base 18 of U-shaped member 2. Headrest 17 extends through recess 6 and out above the upper surface 19 of U-shaped member 2. Thus a lower portion of headrest 17 is housed within recess 6 and an upper portion of headrest 17 extends upwardly from recess 6.

Figure 3:
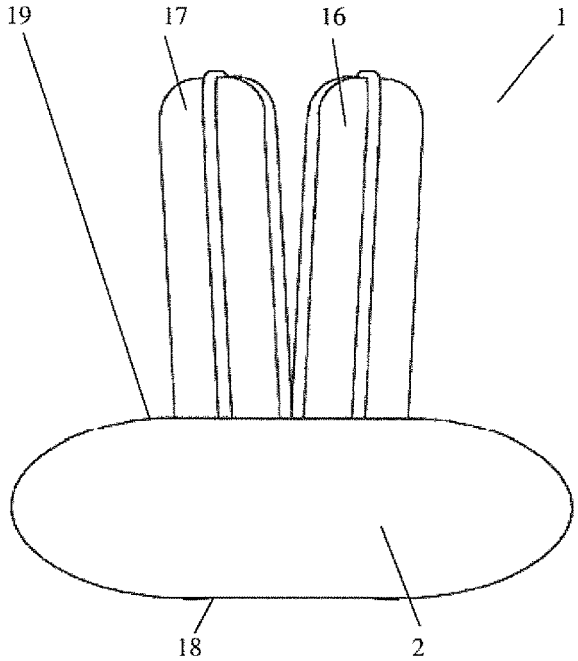
FIG. 3 is a rear view of the pillow of FIG. 1.

The upper portions of headrests 16, 17 are best illustrated in FIG. 3. In the present embodiment these upper portions extend approximately 15 cm above the upper surface 9 of U-shaped member 2.

Both first and second headrests 16, 17 are inflatable and first and second headrests 16, 17 each comprise respective valves (not shown) for inflating and deflating respective headrests 16, 17.

The valves are outwardly facing, i.e. on the respective sides of headrests 16, 17 that face away from recess 6, such that they do not contact a users head when headrests 16, 17 are inflated and pillow 1 is in use.

Figure 4:
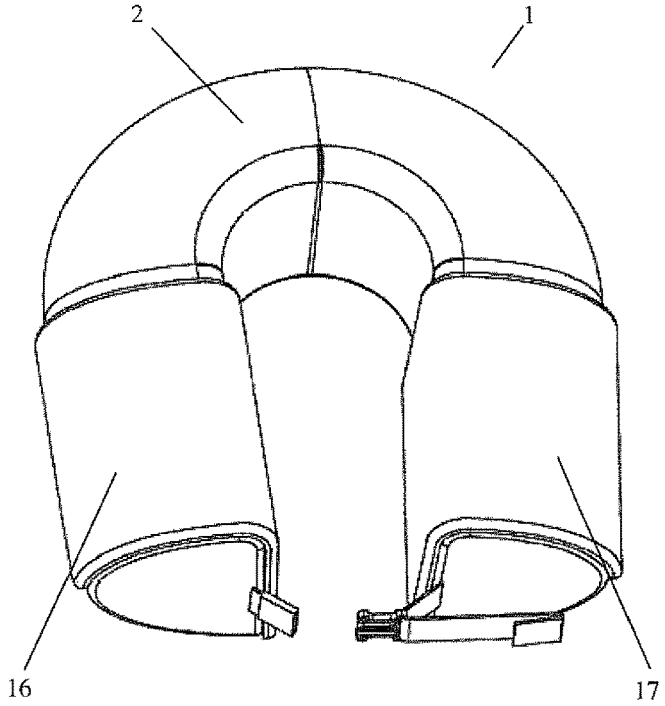
FIG. 4 is a plan view of the pillow of FIG. 1 with its headrests at rest and folded over the side portions of its U-shaped body.

As illustrated by FIG. 4, when not inflated first and second headrests 16, 17 may rest deflated over respective side portions 4, 5.

Figure 5:
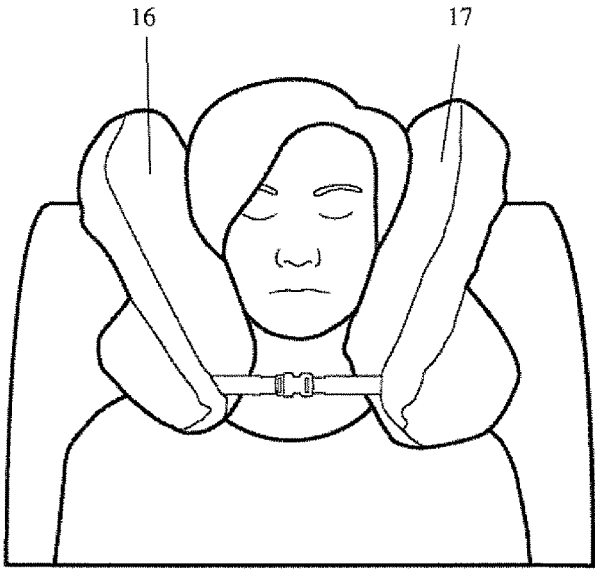
FIG. 5 is a schematic view of the pillow of FIG. 1 being worn by a user.
Figure 6:
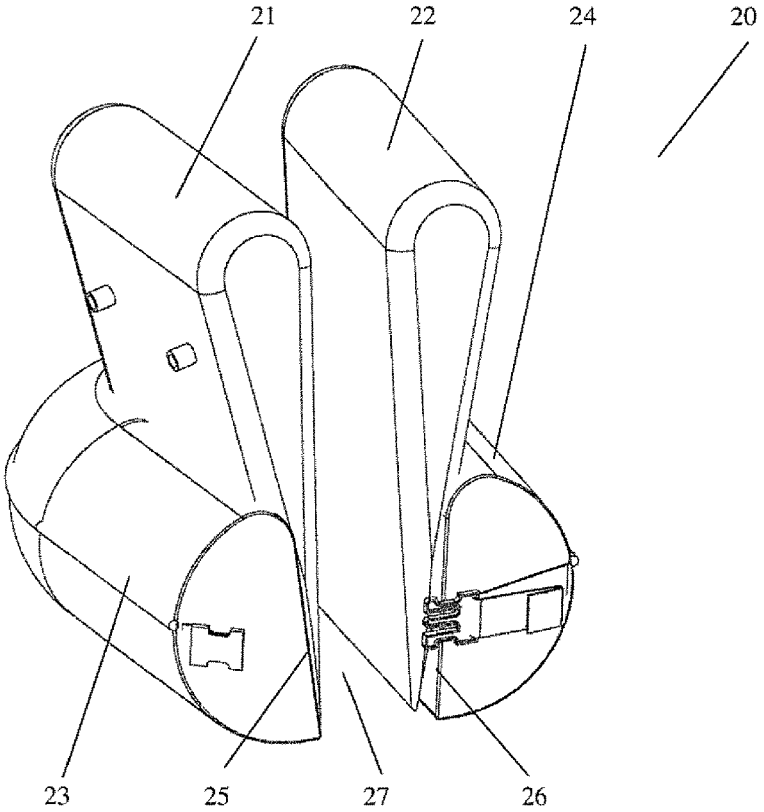
FIG. 6 is a perspective view a pillow made in accordance with a second embodiment of the present invention and with its headrests extended.

Turning to use of pillow 1 when a user deploys headrests 16 and 17 and with reference to FIG. 5, a user may inflate both headrests 16, 17 and position the pillow around their neck.

In doing so the lower parts of headrests 16, 17 are clamped between the lower section of a user's head, in particular their jawbone, and first and second side walls 8, 9 of U-shaped member 2. This clamping may be enhanced by connecting together first and second connector halves 13, 14 and tensioning the connection by adjusting the length of webbing 15.

In clamping the lower parts of headrests 16, 17 pressure is applied thereto, thereby increasing the pressure in the upper parts of the headrests 16, 17 and forcing them to expand such that they remain in contact with the side of a user's head and cover the user's ears.

Thus, with upper parts of headrests 16, 17 covering their ears, a user is able to sleep with their head held in a substantially upright position without interference from ambient noise.

Furthermore, even if a user's head slightly leans to one side the opposite inflatable chamber may expand towards its side of the user's head so as to still cover the ear and block unwanted noise.

Advantageously, as in the present embodiment headrests 16, 17 are independently inflatable a user may deploy a single headrest if so desired.

When a single headrest is deployed the other headrest may remain rest deflated over its respective side portion of U-shaped body 2.

Further, if desired a user is still capable of using U-shaped body 2 in the same manner as a standard travel pillow by inflating neither headrest as illustrated in FIG. 4.

Turning to a second embodiment of the present invention, a travel pillow 20 comprises first and second headrests 21, 22. When inflated first and second headrests 21, 22 are wedge-shaped and are at their narrowest at their respective lower ends that are attached to respective first and second side portions 23, 24 on respective side walls 25, 26, of recess 27. First and second headrests 21, 22 taper out towards their wider upper ends and are thereby configured to rest against a user's ears.

In some embodiments the headrests may be substantially permanently attached to the U-shaped member. In other embodiments the headrests may be releasably attachable by a user to the U-shaped member.

In some embodiments the U-shaped member may comprise a covering that is of a material that operates as one half of hook and loop fastening, preferably the loop part.

With such a U-shaped member the headrests may comprise at least one area of corresponding hook and loop fastening thereby allowing a user to releasably attach headrests to the U-shaped member. Such an embodiment is extremely customisable as the user is able to choose the position and orientation of the headrests.

Many variations are possible without departing from the scope of the present invention as set out in the appended claims.

The invention claimed is:

1. A pillow comprising:

a substantially U-shaped body defining a recess adapted to house the neck of a user, the U-shaped body having a rear portion and first and second side portions that define a rear wall and first and second side walls of the recess and define a shoulder-contacting base and an upper surface;

a first inflatable headrest having a lower part housed in the recess and attached to the first side wall of the recess, the first inflatable headrest extending out of the recess and above the upper surface of the U-shaped body;

a second inflatable headrest having a lower part housed in the recess and attached to the second side wall of the recess, the second inflatable headrest extending out of the recess and above the upper surface of the U-shaped body; wherein first and second inflatable headrests are each alterable between a first configuration wherein they are deflated and a second configuration wherein they are inflated such that respective upper parts of the first and second inflatable headrests extend upwardly from the recess so as to cover respective ears of a user.

2. The pillow of claim 1 wherein at least 15% of lengths of the first and second inflatable headrests are located within the recess and attached to respective first and second side walls thereof in the second configuration.

3. The pillow of claim 1 wherein at least 25% of lengths of the first and second inflatable headrests are located within the recess and attached to respective first and second side walls thereof in the second configuration.

4. The pillow of claim 1 wherein at least 35% of lengths of the first and second inflatable headrests are located within the recess and attached to respective first and second side walls thereof in the second configuration.

5. The pillow of claim 1 wherein the lower parts of the first and second inflatable headrests extend from the base of the U-shaped body to the upper surface of the U-shaped body.

6. The pillow of claim 1 wherein the first and second inflatable headrests are formed separately from the U-shaped body and are releasably attachable respectively to the first and second side walls of the recess.

7. The pillow of claim 1 wherein the U-shaped body comprises a covering at least partly made of a material that acts as one half of hook and loop fastening.

8. The pillow of claim 1 wherein the first and second inflatable headrests are attachable to the U-shaped body by means of hook and loop fastening.

9. The pillow of claim 1 wherein the first and second headrests are independently inflatable.

10. The pillow of claim 1 wherein the first and second inflatable headrests are in fluid communication with each other.

11. The pillow of claim 1 comprising a connector adapted to attach together free ends of the U-shaped body.

12. The pillow of claim 1 wherein the U-shaped body is substantially filled with foam.

13. The pillow of claim 12 wherein the U-shaped body is substantially filled with memory foam.

14. The pillow of claim 1 wherein the U-shaped body is substantially semi-circular in cross-section with the arc of the semi-circle forming the outer wall of the U-shaped pillow and the diameter of the semi-circle forming the rear wall and first and second side walls of the recess.

15. The pillow of claim 1 wherein the first and second inflatable headrests when inflated extends out of the recess by at least 10 cm.

16. The pillow of claim 1 wherein the first and second inflatable headrests when inflated extends out of the recess by at least 15 cm.

17. The pillow of claim 1 wherein the first and second inflatable headrests when inflated extends out of the recess by at least 20 cm.

18. The pillow of claim 1 wherein when the first and second inflatable headrests are inflated and the item is n in use the lower parts of the first and second inflatable headrests contact each other.

* * * * *